US005349272A

United States Patent [19]

Rector

[11] Patent Number: 5,349,272

[45] Date of Patent: Sep. 20, 1994

[54] MULTIPLE OUTPUT BALLAST CIRCUIT

[75] Inventor: Robert E. Rector, Richardson, Tex.

[73] Assignee: Gulton Industries, Inc., Plano, Tex.

[21] Appl. No.: 8,130

[22] Filed: Jan. 22, 1993

[51] Int. Cl.[5] ..... G05F 1/00

[52] U.S. Cl. ..... 315/294; 315/297; 315/244; 315/DIG. 5

[58] Field of Search ..... 315/294, 250, 276, 278, 315/224, 244, 258, 283, 239, 311, 341, 342, DIG. 5, DIG. 7, 297, 212

[56] References Cited

U.S. PATENT DOCUMENTS 2,310,743 2/1943 Moss ..... 315/294

4,100,476 7/1978 Ghiringhelli ..... 315/297

*Primary Examiner*—Robert J. Pascal

*Assistant Examiner*—Haissa Philogene

*Attorney, Agent, or Firm*—Darby & Darby

[57] ABSTRACT

A ballast arrangement is disclosed for use in powering fluorescent and other gas discharge lamps. The ballast arrangement provides both full current and low current outputs for multiple sets of lamps so that dual lamps can be powered simultaneously, at the same or different output levels.

10 Claims, 2 Drawing Sheets

MULTIPLE OUTPUT BALLAST CIRCUIT

BACKGROUND OF THE INVENTION

This invention relates to a circuit for powering fluorescent lamps and more particularly to an improved ballast circuit for simultaneously powering several lamps each at a different level of intensity.

The significantly greater efficiency of fluorescent or discharge lamps, in terms of lumens per watt, as compared to incandescent lamps has contributed greatly to the wide spread use of fluorescent lamps in office buildings, public areas and mass transit vehicles throughout the world. Ballast arrangements installed in these locations have generally provided only a single level light output while a lamp is in its operative state. This output can, in some instances, cause glare in adjacent glass or other reflective surfaces. This is especially true in a vehicle such as a bus in which one or several fluorescent lamps located in the immediate vicinity of a driver could impair the driver's visibility by causing reflections from windows or windshields which produce glare. Accordingly, it would be desirable to provide a ballast arrangement in which one or more fluorescent lamps could be powered at a lower or dimmer level than other lamps without having to use a separate ballast to dim such lamps or having to sacrifice light level output of other lamps coupled to the same ballast.

A multiple light level ballast arrangement for a fluorescent lamp is known in the art. Typically, a fluorescent lamp of conventional design is combined with a ballast circuit which can selectively introduce an added impedance into the circuit to reduce the current flow into the lamp. The reduced current flow causes the lamp to dim.

A basic method of changing the light level of a fluorescent lamp is disclosed in U.S. Pat. No. 2,350,462 to Johns. This method uses a multiply tapped secondary winding of a ballast transformer which is connected to a fluorescent lamp by means of a switch. The switch enables power to flow to the lamp from any of the several taps of the ballast winding. Because each tap of the ballast winding is coupled to the primary winding of the ballast transformer by a different number of turns, the current level provided to the lamp is directly affected by the switch setting.

In U.S. Pat. No. 4,178,535 to Miller another fluorescent light dimming circuit is disclosed, in which the light level of a fluorescent lamp is adjusted by switching from an inductor in series with the lamp to either an inductor plus a resistor in series with the lamp or a different inductor in series with the lamp.

In U.S. Pat. No. 4,358,709 to Magai the output level of a fluorescent lamp is adjusted between a low level light output and a high level light output by shunting a resistor in series with the lamp. The low level circuit includes a series resistor and an inductor in the lamp circuit.

In yet another lamp dimming circuit disclosed in U.S. Pat. No. 3,878,431 to Petrina, a pair of lamps connected in series can be dimmed in unison. This system shunts a series dimming resistor using a "triac" switching device when a high output light level is desired. The triac is normally biased to conduct current and thereby bypass the dimming resistor to provide full current to the lamps. When the triac is biased not to conduct, the dimming resistor is introduced into the lamp current circuit to reduce the lamp current.

These prior art circuits are thus merely dimming circuits to permit a single fluorescent lamp or string of lamps to operate either at high or low output level. There remains a need for a simple ballast circuit capable of driving several lamps each at a different current level to provide both high and low light output.

In accordance with the invention, several lamps may be electrically connected to a single ballast unit each at a separate one of several current output levels. This results in a separate light level output from each lamp, tile level of one lamp being independent of the others.

SUMMARY OF THE INVENTION

It is an object of tile present invention to provide a novel ballast arrangement.

Another object is to provide a ballast circuit to power several fluorescent lamps.

An additional object is to provide a light level circuit to individually determine the light level of each of several electrically connected fluorescent lamps.

A further object of this invention is to provide a ballast arrangement with the foregoing advantages with minimal cost and complexity.

These and other objects are achieved according to the present invention by a single circuit which provides full current or reduced current to respective ones of several lamps so that multiple lamps can be powered simultaneously, each at a different output level, using a particular impedance network.

DETAILED DESCRIPTION OF THE INVENTION

Figure 1:
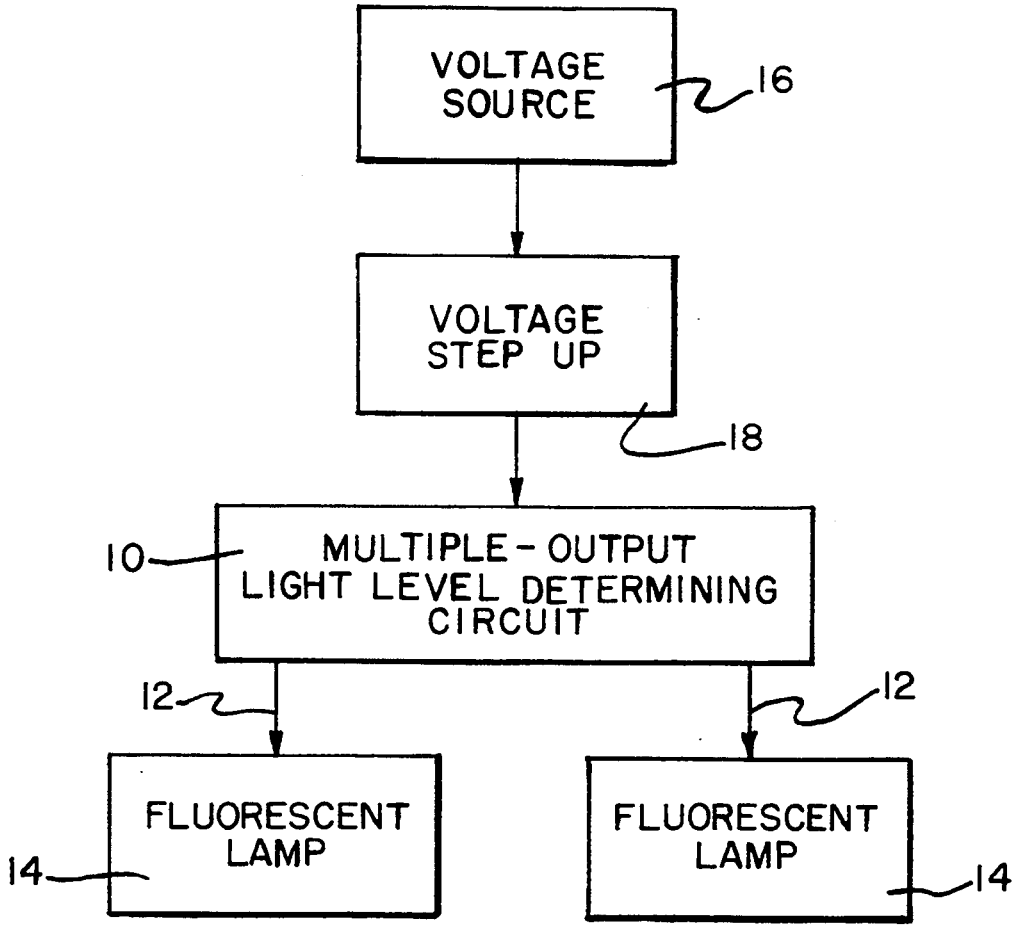
FIG. 1 shows a block diagram of the functional features of a circuit containing a ballast arrangement of the present invention.

Referring to tile drawings, FIG. 1 shows a block diagram of the functional features of a circuit containing the ballast arrangement of the present invention. By way of overview, a voltage source 16 is connected to a voltage step-up device 18 so that the voltage provided at the terminals of a connected lamp will be at a level sufficient to ensure electron-emissive discharge at the lamp cathodes. Where voltage source 16 is a DC source, an inverter circuit (not shown) would be included with voltage step-up device 18 to convert the voltage to AC. The voltage step-up device 18 is connected to a light level determining circuit 10. Light level circuit 10 is arranged to provide multiple current output lines 12 at a single connector 24 for simultaneously powering a plurality of lamps 14 which may be connected to the connector. A significant feature of the present invention, as will be discussed more fully below, is that light level circuit 10 provides differing current levels on several of the output lines 12 to power lamps 14 connected to connector 24 at different intensities.

Figure 2:
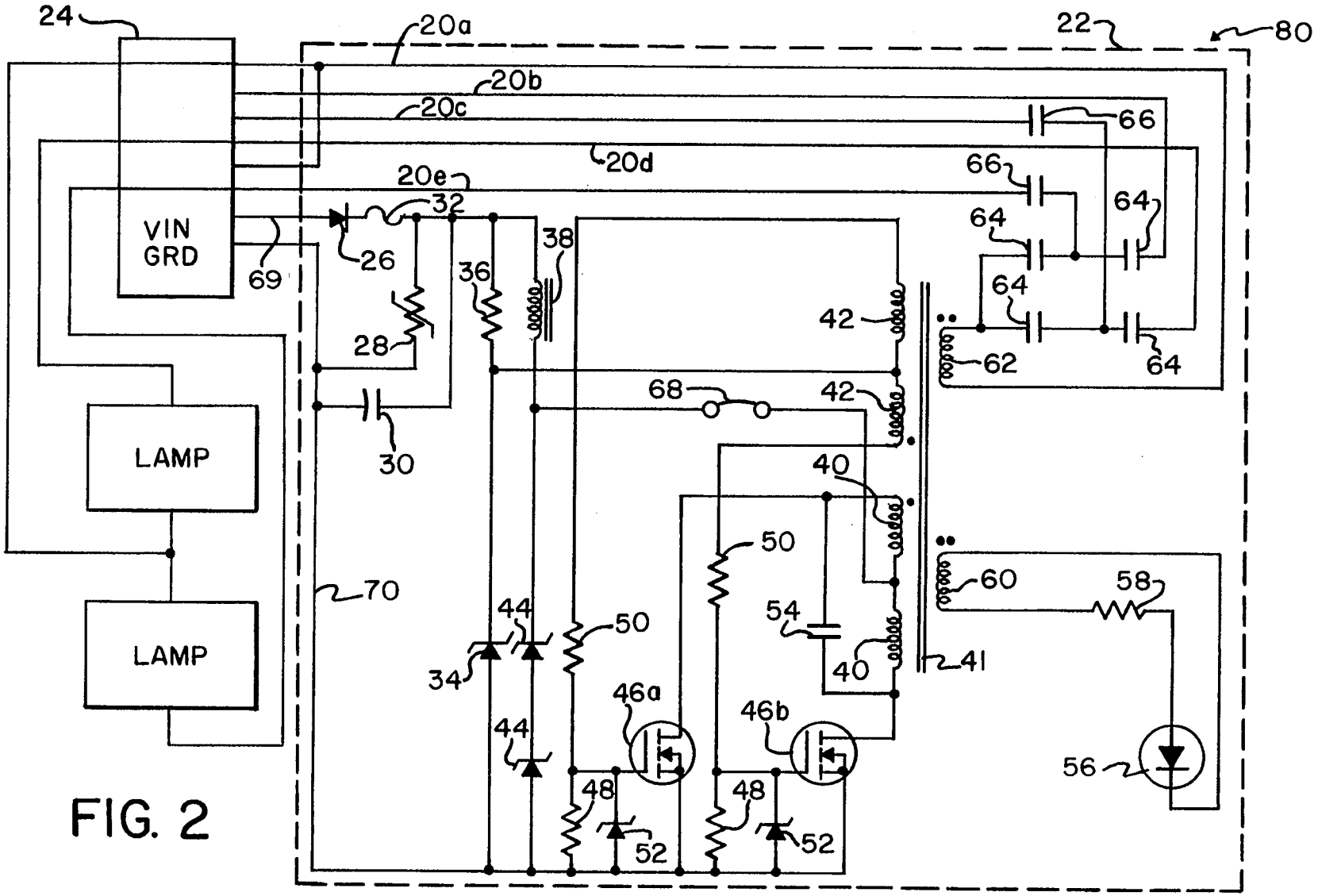
FIG. 2 is a schematic circuit diagram of a circuit of the present invention illustratively connected to two lamps by first and second impedance networks.

FIG. 2 shows a schematic diagram of a preferred embodiment of a ballast module 80 according to the present invention, illustrated as applied to a two-lamp ballast. The ballast module is constructed within a housing 22 which is provided with a connector 24 connected to an input voltage lead 69 and a ground lead 70. The connector also has a plurality of leads 20*a* to 20*e* adapted to be coupled to output lines 12. The ballast module 80 also includes a circuit board (not shown) on which the electronic components are mounted in conventional manner.

Located within the housing 22 are a series of electrical networks generally of the type described in connection with FIG. 1. More particularly, a 24 volt DC source is adapted to be connected across two terminals of connector 24 to provide DC current to the ballast module 80. The high potential input lead 69 from connector 24 is connected to a blocking diode 26 whereas the low potential input lead 70 from connector 24 serves as a ground for the ballast module 80. Blocking diode 26 protects the ballast module from damage which could otherwise result if the module is subject to excessive or reverse voltage and, preferably, is rated at 6 amperes or more.

A current-smoothing and voltage-limiting circuit comprising the parallel combination of a variable resistor 28 and a capacitor 30, is connected between ground lead 70 and the forward conducting side of diode 26. Interposed between blocking diode 26 and variable resistor 28 is a fuse 32 which protects the ballast module 80 from current surges. Capacitor 30 may be of any value suitable for smoothing tile current, for example, about 0.1 $\mu$F at 100 volts, and preferably has a temperature rating of at least 105° C. to avoid dielectric breakdown. Variable resistor 28 serve to limit high voltage transient spikes. An inductor 38, preferably 400 mH at 5A, is connected at a first end to the high potential side of the current-smoothing and voltage-limiting circuit 28,30 and at a second end to a center tap of a winding 40 of transformer T1. Inductor 38 prevents current surges from reaching the winding 40 and likewise prevents voltage surges at the output of transformer T1.

Transformer TI is used in this circuit both as a voltage step-up device and as part of an oscillator described more fully below. Because transformer T1 may get sufficiently hot to damage its windings and because the ballast module 80 may be used in cramped or hot environments, such as near a pipe or during the summer months, a thermostat 68 is interposed between the inductor 38 and the center tap of transformer winding 40 as extra protection for the ballast module 80. On occurrence of excess temperature, the thermostat 68 will shut down the circuit until a more amiable temperature is achieved. In addition to the transformer winding 40, a second transformer winding 42 is formed on the same core 41 and is supplied at its center tap with voltage from a node disposed between a zener diode 34 and a resistor 36, which are connected in series across the current-smoothing and voltage-limiting circuit 28,30. Zener diode 34 regulates the voltage at the center tap of transformer winding 42, and is preferably of the 1N4732 variety capable of regulating the voltage to 4.7 volts. Resistor 36 may be approximately 2.2 kilohms.

An oscillator circuit driven by a pair of n-channel enhancement mode MOSFETs 46 inverts the incoming DC to AC. The drain of each MOSFET is directly connected to opposite ends of the winding 40. A series connection of two zener diodes 44, preferably of the IN6288A variety capable of limiting the voltage across MOSFETs 46 to approximately 150 volts, is connected between the second end of inductor 38 and the ground lead 70. Preferably, the transistors 46 have a rating equal or equivalent to that of an MTW16N40 transistor, that is, having a high voltage rating greater than the series combination of zener diodes 44 and a high current rating suitable for driving several fluorescent lamps 14 connected to the circuit at connector 24. The substrate of each MOSFET is tied to its source contact and the source contact is in turn connected to ground lead 70. In such a configuration, there will be no channel until the gate source voltage exceeds the threshold voltage of the device. When a voltage greater than MOSFET 46's threshold voltage is applied to its gate, a channel will be foraged in the device which causes it to conduct from source to drain.

The gate of each MOSFET 46 is connected to opposite ends of the winding 42 by means of a voltage regulator circuit. The gate voltage of each MOSFET 46 is regulated by the voltage regulator circuit which comprises a voltage divider network of resistors 48, 50 coupled with zener diode 52, preferably of the IN4746 variety capable of clamping the gate-source junction to no more than, illustratively, 18 volts. Resistors 48 and 50 are illustratively 1000 and 200 ohms, respectively.

When a voltage is applied to the gate, a complete circuit will be formed from ground lead 70 through MOSFET 46 to one end of transformer winding 40 through one half of the winding to its center tap and through thermostat 68 to high potential. Because the gate of each MOSFET is tied to a respective opposite end of the center tapped transformer winding 42, the MOSFETs will be alternatively driven into conduction by the switching of currents in windings 40 because the applied gate voltages will have opposite polarity. Initially, one of MOSFETs 46*a*, 46*b* will be electrically favored and the transistors will conduct alternately thereby inducing an alternating current, preferably at approximately 40–50 kilohertz. When MOSFET 46*a* is conducting, a first end of transformer winding 40 will be tied to ground lead 70 through MOSFET 46*a* while a second end will not provide a path for current to flow. This condition will persist until MOSFET 46*b* is driven into conduction at which time MOSFET 46*a* will turn off: the second end of transformer winding 40 will instead be tied to ground lead 70 through MOSFET 46*b*.

Thus, in a secondary winding 62 of transformer T1, there will be induced an alternating voltage having a voltage step-up in proportion to the turns ratio of the transformer. Illustratively, winding 40 may have 5 turns on each side of its center tap, winding 42 may have 3 turns on each side of its center tap, and secondary winding 62 may have 164 turns. A capacitor 54 is connected across opposite ends of transformer winding 40 to smooth the inversion. Illustratively, capacitor 54 may have a capacitance of about 0.022 $\mu$F so that the induced alternating current will approximate a sinusoid at the operating frequency.

A power indicator circuit may also be coupled to core 41 to indicate that the ballast module 80 is operating. Preferably such a circuit would comprise a series connection of a light emitting diode 56 and a suitably chosen resistor 58 connected across a secondary winding 60.

The circuit described herein is suitable for providing current to two lamps at an appropriate driving voltage. With the foregoing in mind, the light level determining circuit 10 is now fully described. One end of the secondary winding 62 is designated as AC common and is connected directly to lead 20*a* which is in turn connected to one of output lines 12 at connector 24. The other end of winding 62 is also connected to connector 24 by leads 20*b* to 20*e* with an impedance network interposed therebetween.

One embodiment of the impedance network of the present invention comprises capacitance connected in series with the secondary winding 62 on each lead 20. In FIG. 2, a dual light level arrangement for two lamps is illustrated. Two pairs of output paths, each of which shares a common impedance value, create different current limiting impedances in each lead 20 connected to connector 24. Each of a first pair of output paths comprises two capacitors 64 connected in series with secondary winding 62 and a respective lead 20*b* or 20*d*. Each of a second pair of output paths comprises a capacitor 66 connected in series with one of the aforementioned capacitors 64 from the first pair of leads. This second pair of output paths is also connected in series with secondary winding 62 to respective leads 20*c* and 20*e*. Series capacitors 64.64 and series capacitors 64, 66 share the voltage across lamp 14 which permits capacitors of lower voltage tolerance and cost to be used in the circuit.

Two fluorescent lamps connected respectively between leads 20*b* and 20*d* on the one hand and common lead 20*a* on the other hand will have the same current determined by the capacitances 64 in series with secondary winding 62. Illustratively, this may be a high current level, providing high level light output. Two other lamps connected respectively between leads 20*c* and 20*e* on the one hand and common lead 20*a* on the other hand will have the same current (which current is different from that in leads 20*b* and 20*d*) determined by the capacitance 64 in series with capacitance 66 and secondary winding 62. Illustratively, this may be a lower current providing a lower level light output. As an example, capacitors 64 may have a value of 0.0018 μF while capacitors 66 may have a value of 0.0036 μF. Thus, the same ballast provides a way of energizing two lamps at high output (by connection to leads 20*b*, 20*d*), or at low output (by connection to leads 20*c*, 20*e*), or one at high and one at low output (by connection, e.g., to leads 20*b*, 20*c* or 20*d*, 20*e*).

The high-level current should properly operate a standard T8 lamp having a normal operating mode of 265 mA. The lower-level current may provide a 190 mA output to produce a dimmed mode of operation for the lamp. This dimmed or reduced current mode saves energy by consuming less current and reducing glare in glass or other reflective surfaces. Similarly, a pair of T12 lamps or a combination of a T8 and T12 lamps can be operated using this ballast arrangement.

While the present circuit has been described for use with fluorescent lamps, which is the most preferred application, the ballast arrangement may be useful in other applications requiring high voltage and several levels of relatively low current in the range described herein, such as with gas discharge lamps which radiate outside the visible spectrum.

From the foregoing description it will be clear that the present invention may be embodied in other specific forms without departing from the spirit or essential characteristics thereof. The presently disclosed embodiment is therefore to be considered as illustrative and not restricted, the scope of the invention being indicated by the appended claims.

What is claimed is:

1. A ballast arrangement for coupling a plurality of fluorescent lamps to a common voltage source, comprising:

a source of alternating voltage;

a transformer coupled to said source to be energized thereby and having an output voltage suitable for driving the plurality of fluorescent lamps;

at least first and second impedance networks connected to the transformer output, each of said impedance networks having a first output terminal and a second output terminal, each of said first terminals being commonly connected to said transformer output:

each of the second output terminals being adapted to be coupled to a respective fluorescent lamp: and at least two of said impedance networks having impedances different from one another, so that when one of the fluorescent lamps is coupled to one of said impedance networks having one impedance and when another of the fluorescent lamps is coupled to another of said impedance networks having another impedance, a first current flowing through the one fluorescent lamp will differ from a second current flowing through said other fluorescent lamp which results in differing luminosity level outputs of said fluorescent lamps, one of said first and second currents being no more than about 250 mA at a voltage necessary to maintain discharge in the fluorescent lamps and the other current being less than said one current level.

2. A ballast arrangement as in claim 1, wherein each of said impedance networks comprises two series connected capacitors.

3. A ballast arrangement as in claim 1, wherein each of said impedance networks has a first capacitor in common with another network and has a respective second capacitor to be coupled to a respective lamp.

4. A multiple output ballast circuit for coupling a plurality of fluorescent lamps to a common voltage source, comprising:

a source of alternating voltage;

a transformer coupled to said source to be energized thereby and having an output voltage suitable for driving the plurality of fluorescent lamps;

at least first and second impedance networks connected to the transformer output, each of said impedance networks including a first capacitor in common with another impedance network and a second capacitor, each of said first capacitors being commonly connected between said transformer output and said second capacitor, each of said second capacitors being adapted to be coupled to a respective fluorescent lamp; and at least two of said impedance networks having impedances different from one another, so that when one of the fluorescent lamps is coupled to one of said impedance networks having one impedance and when another of the fluorescent lamps is coupled to another of said impedance networks having another impedance, a first current flowing through the one fluorescent lamp will differ from a second current flowing through said other fluorescent lamp which results in differing luminosity level outputs of said fluorescent lamps.

5. A ballast arrangement as in claim 4, wherein one of said second capacitors has greater capacitance than the other of said second capacitors.

6. A ballast arrangement as in claim 4, wherein one of said first or second capacitors has greater capacitance than the other.

7. A ballast arrangement for coupling any one or more of several fluorescent lamps to a common voltage source, comprising:

a transformer having a secondary winding;

a source of alternating voltage coupled to said transformer;

a first impedance network comprising a first capacitor connected in series to said winding;

a second impedance network comprising a second capacitor connected in series to said winding; and a connector connected to the outputs of said networks and adapted to be coupled to one or more fluorescent lamps, one of said first capacitor or said second capacitor having greater capacitance than the other so that when the fluorescent lamps are connected to both of said impedance networks, one level of current will flow through the lamp connected to said first impedance network while another level of current will flow through the lamp connected to said second impedance network, whereby one of the lamps will be dimmer than the other.

8. A ballast arrangement as in claim 7, wherein both fluorescent lamps are connected to either of said impedance networks.

9. An inverter-ballast arrangement for coupling two fluorescent lamps to a common direct voltage source, comprising:

an inverter circuit for converting direct current to alternating current comprising an oscillator circuit including a transformer with a pair of magnetically coupled windings, said transformer also including a secondary winding;

first and second impedance networks each comprising a first capacitor connected in series to said secondary winding and a second capacitor connected in series with said first capacitor, said networks having their first capacitors in common;

third and fourth impedance networks each comprising a third capacitor connected in series to said secondary winding and a fourth capacitor in series with said third capacitor, said third and fourth networks having their third capacitors in common: and a connector coupled to said second and fourth capacitors and adapted to be connected to respective fluorescent lamps, one of said second capacitors being of greater capacitance than the other, so that different levels of current will flow through fluorescent lamps connected to said first and second impedance networks, one of said fourth capacitors also being of greater capacitance than the other, so that different levels of current will flow through fluorescent lamps connected to said third and fourth impedance networks, whereby a fluorescent lamp connected to one of said first or second impedance networks or one of said third and fourth impedance networks will be dimmer than a lamp connected to the other.

10. A multiple output ballast circuit for coupling a plurality of fluorescent lamps to a common voltage source, comprising:

a source of alternating voltage;

a transformer coupled to said source to be energized thereby and having an output voltage suitable for driving the plurality of fluorescent lamps;

at least first and second impedance networks connected to the transformer output, each of said impedance networks comprising two series connected capacitors and having a first output terminal and a second output terminal, each of said first output terminals being commonly connected to said transformer output;

each of the second output terminals being adapted to be coupled to a respective fluorescent lamp; and at least two of said impedance networks having impedances different from one another, so that when one of the fluorescent lamps is coupled to one of said impedance networks having one impedance and when another of the fluorescent lamps is coupled to another of said impedance networks having another impedance, a first current flowing through the one fluorescent lamp will differ from a second current flowing through said other fluorescent lamps which results in differing luminosity level outputs of said fluorescent lamps.

* * * * *